United States Patent [19]

Frei

[11] Patent Number: 4,509,352

[45] Date of Patent: Apr. 9, 1985

[54] SPRING COILING MACHINE

[75] Inventor: Max Frei, Schönenwerd, Switzerland

[73] Assignee: Schenker Maschinen AG, Schönenwerd, Switzerland

[21] Appl. No.: 494,183

[22] Filed: May 13, 1983

[30] Foreign Application Priority Data

May 24, 1982 [CH] Switzerland ..... 3176/82
Sep. 20, 1982 [CH] Switzerland ..... 5531/82

[51] Int. Cl.[3] ..... B21F 3/02
[52] U.S. Cl. ..... 72/138
[58] Field of Search ..... 72/30, 32, 35, 36, 135, 72/138, 140

[56] References Cited

U.S. PATENT DOCUMENTS

| | | | |
|---|---|---|---|
| 537,472 | 4/1895 | Miller | 72/138 X |
| 2,161,084 | 6/1939 | Peterson et al. | 72/138 X |
| 2,175,426 | 10/1939 | Blount et al. | 72/138 X |
| 2,373,427 | 4/1945 | Stickney | 72/138 X |
| 2,455,863 | 12/1948 | Halvorsen | 72/138 X |
| 2,765,022 | 10/1956 | Bergevin | 72/138 X |
| 3,740,984 | 6/1973 | Bergevin | 72/138 X |

FOREIGN PATENT DOCUMENTS

| | | | |
|---|---|---|---|
| 565761 | 7/1977 | U.S.S.R. | 72/138 |
| 578145 | 10/1977 | U.S.S.R. | 72/138 |

*Primary Examiner*—E. Michael Combs
*Attorney, Agent, or Firm*—Peter K. Kontler

[57] ABSTRACT

A spring coiling machine wherein the wire is fed lengthwise and is acted upon by a tool receiving motion from two coaxial rotary disc cams through the medium of follower levers which track the respective cams. One of the cams controls the position of the tool during the initial stage or stages and the other cam controls the position of the tool during the remaining stage or stages of the making of each of a series of springs. The angular position of each cam with reference to the other cam is adjustable to thereby change the timing of transmission of motion from the adjusted cam to the tool during each cycle of the machine. The positions of the follower levers with reference to the associated cams are also adjustable to thereby vary the extent of movement of the tool during each cycle. Each of the two cams forms part of a group of coaxial cams, and any selected cam of each group can be shifted axially into engagement with the respective follower lever to thereby change the pattern of movement of the follower levers during engagement with the selected cams. A pawl can be provided to hold one of the follower levers out of engagement with the respective cam before and/or while the other cam is tracked by the respective follower lever so that the position of the tool is then determined by the pawl or by the other follower lever and the associated cam.

24 Claims, 6 Drawing Figures

SPRING COILING MACHINE

BACKGROUND OF THE INVENTION

The present invention relates to spring coiling machines in general, especially to automatic spring coiling machines. More particularly, the invention relates to improvements in spring coiling machines of the type wherein a tool, e.g., a so-called pitch selector tool, is movably mounted in or on the machine frame and is adjustable in response to rotation of a cam through the medium of a linkage which derives motion from the cam. Still more particularly, the invention relates to improvements in preferably automatic spring coiling machines of the type wherein the phase relationship of the cam with reference to the cycles of the machine is adjustable.

In conventional spring coiling machines of the above outlined character, the cam comprises a driven central portion which carries a lobe serving to determine the movements as well as the position of the tool following the start and preceding completion of the making of a coiled spring. The central portion of the cam carries detachable and adjustable segments which determine the nature or pattern of movement of a follower into engagement with and away from engagement with the aforementioned lobe to thus control the making of the foremost and rearmost portions of coiled springs. In other words, whenever the machine is to turn out a different spring or a different series of springs, the previously utilized segments must be adjusted or replaced until the operator is satisfied that the springs which are turned out by the machine match the desired norm. This entails considerable losses in time, as well as in valuable material of the springs, in addition to unnecessary wear upon various parts of the machine during adjustment of the segments and/or during replacement of previously used segments with fresh segments. The problem is aggravated if the machine is used for the making of short series of springs so that the aforementioned segments of the cam must be adjusted and/or replaced at frequent intervals. This can greatly increase the cost of each short series of springs and can entail considerable wear upon the machine at times when the machine is in the process of being set up for the making of a different series or batch of springs.

OBJECTS AND SUMMARY OF THE INVENTION

An object of the invention is to provide a novel and improved spring coiling machine which is constructed and assembled in such a way that the duration of down times between the production of successive series of different springs is but a minute fraction of down times in conventional machines.

Another object of the invention is to provide a spring coiling machine which can turn out a surprisingly large number of different types of springs and which can turn out short or long series of identical springs at timely spaced intervals without any experimentation or trial runs.

A further object of the invention is to provide a spring coiling machine wherein the number of rejects is reduced to a small fraction of rejects in heretofore known machines.

An additional object of the invention is to provide a spring coiling machine wherein all such parts which require attention or manipulation are readily accessible from a single location and which is equipped with a variety of simple but effective and versatile means for facilitating rapid and accurate adjustment preparatory to the making of different series of springs.

Still another object of the invention is to provide novel and improved sets or groups of cams and novel and improved motion transmitting devices for use in a spring coiling machine of the above outlined character.

An additional object of the invention is to provide a machine which is just as effective for the making of long series of identical springs as it is for the making of medium long, short or very short series or batches.

Another object of the invention is to provide a novel and improved method of manipulating a spring coiling machine so that the number of rejects is smaller and that the down times are shorter than in heretofore known machines.

A further object of the invention is to provide the machine with novel and improved means for controlling the movement of the tool which determines one or more characteristics of the springs.

The invention is embodied in a machine for converting wire into a series of coiled springs during successive operating cycles of the machine. The machine comprises a frame, housing or an alalogous support, feeding means preferably mounted on or in the support and serving to advance the wire along a predetermined path (preferably lengthwise), a wire treating tool (e.g., a pitch selector tool) which is mounted in or on the support for movement with reference to the path of the wire to thereby influence the characteristics of the springs, and means for moving the tool with reference to the path of movement of the wire. The moving means comprises first and second rotary cams and means for transmitting motion from the cams to the tool. The motion transmitting means comprises first and second follower means which track the respective cams during first and second stages of each cycle so that the first cam determines the position of the tool during the making of a first portion and the second cam determines the position of the tool during the making of the remainder of each spring. The machine further comprises adjusting means for changing the position of at least one of the cams with reference to the other cam to thereby change the timing of transmission of motion from the one cam to the tool during successive cycles. The first and second cams are preferably coaxial and the adjusting means preferably comprises means for turning the one cam with reference to the other cam about the common axis of the two cams. Each cam is preferably a disc cam and each of these disc cams comprises a section which is tracked by the respective follower means during each revolution of the cam. The first follower means is arranged to track the section of the first cam during the initial stage and the second follower means is arranged to track the section of the second cam during the last stage of the making of a spring.

The means for rotating the cams preferably includes coaxial first and second shafts which are arranged to drive the respective cams and a further (driver) shaft or other suitable means for driving the first and second shafts. The adjusting means then preferably comprises means for changing the angular position of at least one of the first and second shafts with reference to the other of these shafts.

In accordance with a presently preferred embodiment of the invention, the adjusting means preferably comprises discrete first and second adjusting devices for the respective cams. Each such adjusting device can comprise a handle (e.g., a rotary crank) which is disposed at the exterior of the support. Such machine preferably further comprises first and second means for indicating the positions of the respective cams with reference to one another and/or with reference to the support. Each such indicating means can comprise a scale or an analogous indicia bearing member which is secured to the support or to the handle and a pointer member which is adjacent to the indicia bearing member and is mounted on the handle or on the support so that one of these members shares the movements of the handle and thereby moves with reference to the other member.

The means for rotating the cams preferably further comprises adjustable first and second transmissions which receive motion from a driver element (such as the aforementioned further shaft) and transmit torque to the respective shafts. The adjusting means then comprises or can comprise means for changing the angular position of at least one of the first and second shafts with reference to the other of these shafts through the intermediary of the respective transmission. Each of the transmissions is preferably a planetary including a first sun gear driven by the driver element, a second sun gear arranged to drive the respective (first or second) shaft, a planet carrier which is rotatable by the respective adjusting device, and planet pinion means mounted in the carrier and meshing with the respective first and second sun gears.

Each of the follower means can comprise a lever having a first arm tracking the respective cam and a second arm, and the moving means then further comprises means for transmitting motion from the second arms of the levers to the tool. Such machine preferably further comprises means for varying the ratio of effective lengths of the first and second arms of each lever. Such varying means preferably comprises pivots for the two levers and means for moving the pivots with reference to the respective levers. The means for moving the pivots can comprise suitable handles (e.g., rotary cranks) which are mounted on the support and the machine can further comprise means for indicating the positions of the pivots with reference to the associated levers. Such indicating means can be constructed in the same way as the aforediscussed indicating means, i.e., each thereof can comprise a stationary or movable indicia bearing member and a movable or stationary pointer member which is adjacent to the respective indicia bearing member.

Still further, the improved machine can comprise at least one additional first and at least one additional second cam. The first cams form a first group, and the second cams form a second group of preferably coaxial cams which are shiftable by suitable forks or the like in the direction of their common axis to thereby move a selected first cam into register with the first follower means and a selected second cam into register with the second follower means. Each of the first and second cams can be designed to allow for the making of a different spring.

As mentioned above, the first cam can comprise a section which is tracked by the first follower means during the initial stage of the making of each spring, and the second cam can comprise a section which is tracked by the second follower means during the last stage of the making of each spring. One of the cams can further comprise a second section which is or can be tracked by the respective follower means during the intermediate stage of the making of each spring. Such machine can further comprise a pawl or other suitable means for disengaging the follower means for the other cam from the respective cam during the intermediate stage of the making of each spring. In other words, the position of the tool is then determined by the disengaging means (by holding the respective follower means in a given position) or by the other follower means which is free to track the respective cam. The retaining means can comprise the aforementioned pawl and control means for engaging the pawl with or for disconnecting the pawl from the respective follower means as a function of the angular position of the one cam. The control means can comprise a further cam which is driven by the shaft for the one cam and means for transmitting motion from such further cam to the pawl.

The novel features which are considered as characteristic of the invention are set forth in particular in the appended claims. The improved spring coiling machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
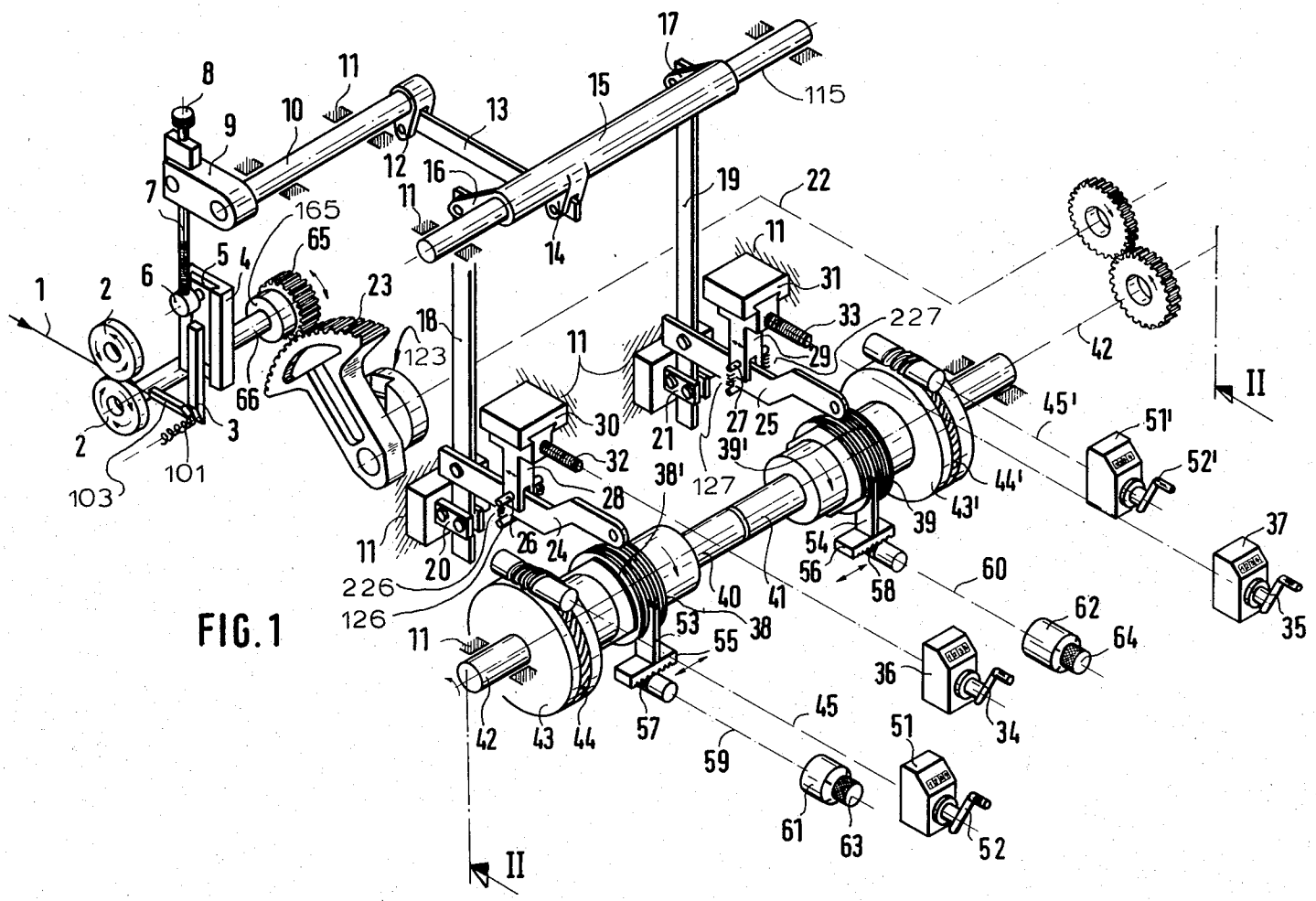
FIG. 1 is a fragmentary exploded perspective view of a spring coiling machine which embodies one form of the present invention.

FIG. 1 shows a portion of a spring coiling machine which converts a continuous wire 1 into a succession of coil springs 101. The wire 1 is drawn from a barrel or another suitable source of supply, not shown, and is advanced along a straight path by a pair of advancing rolls 2 (also called feed rollers). The bending tools against which the wire 1 is fed convert successive unit lengths of the wire 1 into springs 101. Such bending tools cooperate with a wire treating pitch selector tool 3 which is movable in directions at right angles to the direction (path) of advancement of the wire 1 and is confined to such movement by a guide 4 which is fixedly mounted in a support here shown as the machine frame 11. As can be readily seen in FIG. 1, the guide 4 has a dovetailed groove for a complementary holder 5 which is fixedly connected to the tool 3 and carries an internally threaded cylindrical member 6 which constitutes a nut and meshes with the externally threaded shank of an adjusting screw or bolt 7 having a knurled head 8. The shank of the screw 7 extends through the diametrical tapped bore of the nut 6 and is rotatably mounted in a lever 9. The adjusting screw 7 cannot move axially with reference to the lever 9 so that the attendant can change the distance between the nut 6 and the lever 9 by the simple expedient of rotating the knurled head 8 of the adjusting screw. The character 103 denotes a knife.

The lever 9 forms part of a means for moving the tool 3 transversely of the direction of feed of the wire 1 and is rigidly connected with one end portion of a rocking shaft 10 which is mounted in suitable bearings (not specifically shown) of the machine frame 11. The other end portion of the shaft 10 is rigidly connected with a second lever 12 which is movably coupled to one end portion of a link 13. The other end portion of the link 13 is movably coupled to a lever 14 which is provided on or fixedly connected to a cylindrical sleeve 15 turnable back and forth on a shaft 115 which is mounted in the frame 11. The sleeve 15 is integral with or rigidly connected to a pair of spaced-apart levers 16 and 17 which are movably coupled to elongated links 18 and 19, respectively. The links 18 and 19 are reciprocable in discrete bearings 20 and 21 which are fixedly mounted in the frame 11. Each lengthwise movement of the links 18, 19 is converted into a rocking movement of the cylindrical sleeve 15 about the axis of the shaft 115 whereby the sleeve 15 moves the link 13 lengthwise to turn the shaft 10 through the medium of the lever 12 whereby the lever 9 moves the adjusting screw 7 axially to change the position of the tool holder 5 with reference to the stationary guide 4. In other words, the parts 18, 19, 15, 13, 10, 9 and 7 can move the tool 3 up and down (as viewed in FIG. 1), depending on the direction of angular movement of the sleeve 15.

The wire 1 is fed axially by a mechanism which receives motion from the synchronizing or timing shaft 22 of the machine. The timing shaft 22 is driven in a clockwise direction and transmits motion to a gear segment 23 which is in mesh with a pinion 65 mounted on a shaft 66 through the medium of a one-way clutch 165 which can rotate the shaft 66 only in a clockwise direction, as viewed in FIG. 1. Thus, the shaft 66 rotates the lower advancing roll 2 and the latter advances the wire 1 because such wire extends into the nip of the rolls 2. The rolls 2 advance the wire 1 axially whenever the gear segment 23 is caused to move in a counterclockwise direction, as viewed in FIG. 1. The timing shaft 22 receives motion from the main prime mover (e.g., a 3-step motor), not shown, of the machine. The extent of indexing of the advancing rolls 2 is variable by changing the position of the gear segment 23 with reference to a transmission 123 which receives motion from the timing shaft 22. The transmission 123 may be of the type disclosed in U.S. Pat. No. 4,232,484 granted Nov. 11, 1980 to Backmann for "Apparatus for moving toll bars or the like". The purpose of this transmission is to convert the unidirectional angular movement of the timing shaft 22 into back-and-forth movements of the gear segment 23.

The means for reciprocating the links 18, 19 comprises two cam followers 24, 25 each of which constitutes a two-armed lever. These levers are respectively mounted on and rockable about pivot members 26, 27 which are installed in discrete carriers 28, 29. The lower portions of the links 18, 19 are movable coupled to the respective arms of the levers 24, 25 and the other arms of these levers preferably carry rollers (not specifically shown) which can track the peripheral surfaces of disc cams 38, 38' and 39, 39', respectively.

The carriers 28, 29 for the respective pivot members 26, 27 have dovetailed upper portions which are slidable in complementary dovetailed grooves of bearing 30, 31 which are fixedly installed in the frame 11. The pivot members 26 and 27 engage the upper sides (upper edge faces) of the respective levers 24, 25 and are movable along such upper sides in response to movement of the respective carriers 28, 29 with reference to their bearings 30 and 31. The means for biasing the median portions of the levers 24, 25 against the respective pivot members 26, 27 comprises pins 126, 127 which engage the undersides of the respective levers 24, 25 and are attached to the corresponding pivot members 26, 27 by coil springs 226, 227.

The means for moving the carriers 28, 29 lengthwise of the respective levers 24, 25 to thereby change the ratio of the effective lengths of the arms of each of these levers comprises means for moving the carriers 28, 29 and the pivot members 26, 27 with reference to the associated bearings 30, 31. Such moving means includes feed screws 32, 33 which extend into tapped bores of the respective carriers 28, 29 and are rotatably mounted in, but cannot move axially relative to, the frame 11. Those end portions of the feed screws 32, 33 which are remote from the carriers 28, 29 respectively carry cranks 34, 35 or other suitable rotary handles. These cranks are readily accessible from the outside of the machine and are adjacent to stationary position indicating means or counters 36, 37 which can display information denoting the angular positions of the respective feed screws 32, 33 and hence the positions of the pivot members 26, 27 with reference to the corresponding levers 24, 25. The counters 36, 37 are designed to change the displayed information in response to rotation of the respective feed screws 32, 33 in a manner which is not specifically shown in the drawing. Such counters are mounted in or on the frame 11 and, in addition to displaying information pertaining to the positions of the pivot members 26, 27, preferably also constitute bearings for the respective end portions of the feed screws 32, 33. These counters can be replaced with indicia bearing members in the form of graduated scales cooperating with pointer members or markers which are then provided on the feed screws 32 and 33. Alternatively, the scales can be mounted on the feed screws 32, 33 to move along fixedly mounted markers on the frame 11. All that counts is to provide suitable means which can indicate the angular positions of the feed screws 32, 33 and hence the positions of pivot members 26, 27 with reference to the associated levers 24 and 25.

As mentioned above, rotation of the feed screws 32, 33 through the medium of the respective cranks 34, 35 entails changes in the effective lengths of the arms of the two-armed levers 24, 25 and hence the extent of lengthwise movement of the links 18, 19 in response to pivoting of these levers when the disc cams 38, 38' and 39, 39' rotate. Thus, the attendants can change the ratio at which the levers 24, 25 transmit motion from the respective disc cams to the tool 3. These levers can step such ratio up or down, depending on the direction of sidewise displacement of the corresponding pivot members 26 and 27. The extent of reciprocatory movement of the links 18 and 19 is increased if the pivot members 26, 27 are moved in a direction to the right, as viewed in FIG. 1. The extent of reciprocatory movement of the links 18, 19 in response to pivoting of the respective levers 24, 25 can be ascertained by observing the information which is displayed by the respective counters 36 and 37 or by the aforediscussed stationary or rotatable scales.

The disc cams 38 and 38′ are mounted on a first hollow shaft 40, and the disc cams 39, 39′ are mounted on a second hollow shaft 41 which is coaxial with the shaft 40. Each of the cams 38, 38′ can control the movements of the tool 3 during the initial and a next-following stage of the making of a coil spring, and each of the cams 39, 39′ controls subsequent stages (including the last stage) of the making of a spring. In other words, a selected cam 38 or 38′ will determine the configuration of the foremost and preferably certain median convolutions of each spring, and a selected cam 39 or 39′ will determine the configuration of the remaining median as well as of the last or rearmost convolutions of each spring. These cams are driven at the same speed to rotate in a clockwise direction, as viewed in FIG. 1, and their peripheral cam faces can be configurated in a manner as shown in greater detail in FIG. 5. Thus, each of the cams 38, 38′ includes a first portion or section whose diameter increases (as considered in the direction of rotation of such cam, a second portion or section whose radius is constant, and a third section of a radius which is so small that the third section cannot be tracked by the respective arm of the lever 24. Each of the cams 39, 39′ includes a first portion or section (again as considered in the direction of rotation of the cam) which has a constant radius, a second section or portion whose radius decreases, and a third portion or section whose radius is so small that the third section cannot be tracked by the respective arm of the lever 25. The levers 24 and 25 track the respective cam sections of constant radii while the tool 3 determines the characteristics of the median portion of a spring, the lever 24 tracks the first portion of a cam 38 or 38′ during the making of foremost convolutions of a spring, and the lever 25 tracks the second section of a cam 39 or 39′ during the making of the last or rearmost convolution or convolutions of a spring.

The cams 38, 38′ and 39, 39′ are non-rotatably but axially movably secured to the respective hollow shafts 40, 41, and these hollow shafts are rotatably mounted on a driver element or shaft 42 which is rotated by the timing shaft 22 through a system of gears shown but not referenced in FIG. 1.

Figure 2:
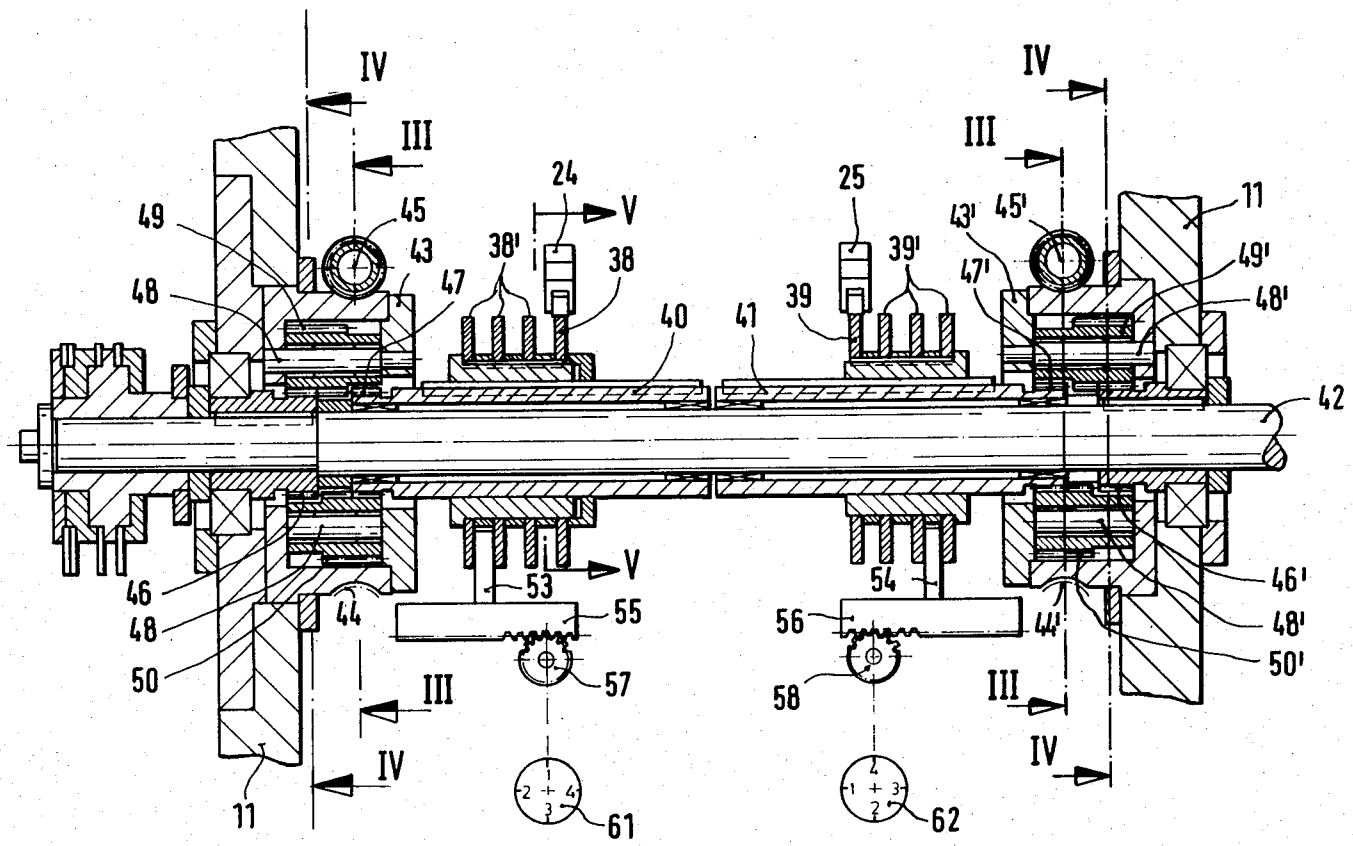
FIG. 2 is an enlarged transverse vertical sectional view as seen in the direction of arrows from the line II—II in FIG. 1.
Figure 3:
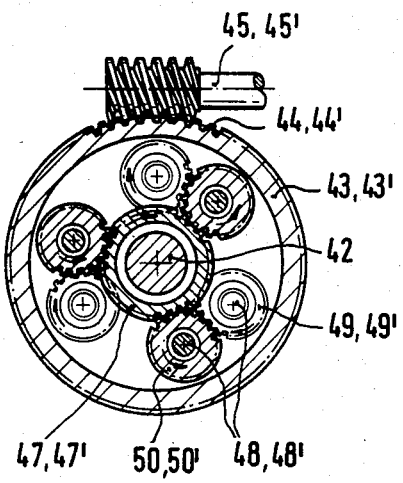
FIG. 3 is a sectional view as seen in the direction of arrows from either of the two lines III—III shown in FIG. 2.
Figure 4:
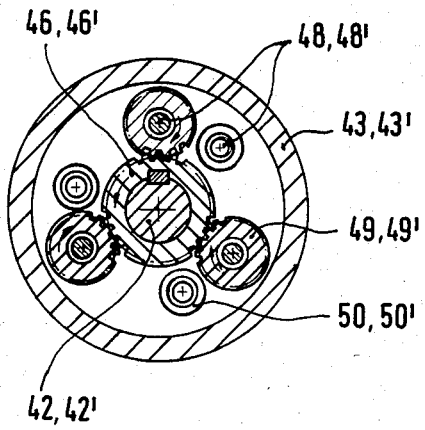
FIG. 4 is a sectional view as seen in the direction of arrows from either of the two lines IV—IV shown in FIG. 2.

The angular positions of the disc cams 38, 38′ and 39, 39′ relative to each other are adjustable by two discrete adjusting devices so that the cams are driven in synchronism with the shaft 42 but their phase relation can be changed. This renders it possible to select the extent of overlap between the constant-radius section of the selected cam (38 or 38′) which is tracked by the lever 24 and the constant-radius section of the selected cam (39 or 39′) which is tracked by the lever 25. Such selection (i.e., the extent of overlap) will be made in dependency on the length of the median portions of springs which are manufactured in the improved machine. The adjusting devices for changing the extent of overlap between certain sections of the cams which are being tracked by the levers 24 and 25 are illustrated in detail in FIGS. 1, 2, 3 and 4. Such adjusting devices effect a change in the angular positions of the cams 38, 38′ with reference to the cams 39, 39′ and/or vice versa. The following description will deal primarily with the cam 38 because the parts which adjust the angular positions of the cams 38′ and the parts for adjusting the angular positions of the cams 39, 39′ are analogous. As can be seen in FIG. 2, the parts of the device which adjusts the angular position of the cam 39 or of the cams 39′ are denoted by the same numerals as those used to denote the parts of the adjusting device for the cams 38, 38′ but the reference numerals denoting parts which are used to adjust the cams 39, 39′ are followed by primes. The two sets of parts (i.e., the two adjusting devices) are mirror symmetrical to one another with reference to a plane which intersects the driver shaft 42 between the neighboring end faces of the hollow shafts 40 and 41.

Referring now to the device for adjusting the angular position of the cam 38 or of the cams 38′, the machine frame 11 supports a planet carrier or housing 43 which forms part of a first planetary, which has a substantially cylindrical external outline and which is axially traversed by the driver shaft 42. The peripheral wall of the planet carrier 43 has a set of worm threads 44 in mesh with a worm shaft 45 which is rotatable in but cannot move axially with reference to the frame 11. That end portion of the worm shaft 45 which is remote from the planet carrier 43 is provided with a rotary handle in the form of a crank 52 and is journalled in a counter 51 serving as a means to indicate the angular position of the planet carrier 43.

The planet carrier 43 surrounds a first sun gear 46 which is non-rotatably affixed to the driver shaft 42 and a second sun gear 47 which is non-rotatably secured to the hollow shaft 40. Furthermore the planet carrier 43 supports three pairs of shafts 48 which are uniformly distributed about the axis of the driver shaft 42 and are parallel thereto. Each of the shafts 48 rotatably mounts a planet pinion. The planet pinions include those numbered 49 and those numbered 50. One shaft 48 of each pair of such shafts carries a planet pinion 49, and the other shaft 48 of the respective pair of shafts carries a planet pinion 50. Each of the planet pinions 49 meshes with the first sun gear 46 and with the adjacent planet pinion 50, and each planet pinion 50 further meshes with the second sun gear 47. If the feed screw 45 is rotated by the crank 52 to change the angular position of the planet carrier 43 with reference to the driver shaft 42, the hollow shaft 40 is also caused to change its angular position together with the cam 38 which is non-rotatably but axially movably connected thereto. Such adjustment of the angular position of the hollow shaft 40 and cam 38 with reference to the driver shaft 42 can take place while the machine is in actual use, i.e., while the driver shaft 42 receives torque from the main prime mover of the machine. Thus, the phase relation of the cam 38 with reference to the driver shaft 42, which is rotated at the same speed, can be adjusted by the simple expedient of rotating the feed screw 45. Otherwise stated, the angular position of the feed screw 45 is indicative of the phase relation of the cam 38 with reference to the driver shaft 42, and the extent of angular displacement of the feed screw 45 from a preceding to the next position is indicative of the extent of adjustment of phase relation of the cam 38 with reference to the driver shaft 42. The counter 51 for the feed screw 45 is installed in or on the frame 11. The crank 52 can be replaced with a hand wheel or by any other suitable handle for rotating the feed screw 45.

It can be said that the second sun gear 47 and the hollow shaft 40 constitute a first half shaft, and that the second sun gear 47′ and the corresponding hollow shaft 41 constitute a second half shaft which is coaxial with the first half shaft.

Basically, the movements of the tool 3 are influenced by the configuration of the cams 38, 38′ and 39, 39′. As mentioned above, one of the cams 38, 38′ determines the movements of the tool 3 during the initial and normally also during the next-following stage of the making of a spring, whereas the cam 39 or one of the cams 39′ determines the movements of the tool 3 during the remaining stages (including the last stage) of the making of a spring. As a rule, the tool 3 is not moved during the making of the median portion of a cylindrical spring, i.e., at such time, the angular positions of the levers 24 and 25 remain unchanged. This is ensured by selecting the radii of the corresponding sections or portions of the selected cam 38 or 38′ and of the selected cam 39 or 39′ in such a way that movement of these cam sections past the locus of contact with the respective levers 24 and 25 does not entail any lengthwise shifting of the links 18 and 19. By rotating the feed screws 45 and 45′ via cranks 52 and 52′, the attendant can adjust the intervals during which the angular positions of the levers 24 and 25 remain unchanged in spite of the fact that a selected cam 38 or 38′ rotates with reference to the lever 24 and that a selected cam 39 or 39′ rotates with reference to the lever 25. The attendant can adjust only the angular position of the feed screw 45 or only the angular position of the feed screw 45′. It will be noted that the angular positions of the feed screws 45 and 45′ determine the length of intervals during which the angular positions of the levers 24, 25 remain unchanged during a cycle, whereas the angular positions of the feed screws 32, 33 determine the extent to which the levers 24 and 25 pivot the respective links 18 and 19 during each cycle, i.e., the feed screws 32 and 33 determine the motion transmitting ratio of the levers 24 and 25.

The counters 36, 37, 51 and 51′ perform the additional important and advantageous function of allowing for repeated manufacture of identical springs by the simple expedient of recording the settings (angular positions) of the respective feed screws 32, 33, 44, 45′ during the making of a given series of springs and by thereupon restoring such setting when the machine is to turn out a second series of the same type of springs. In other words, the provision of such counters renders it possible to dispense with experimentation and with the making of unsatisfactory specimens when the persons in charge elect to make a series of springs exhibiting a predetermined set of characteristics. This reduces the down times and contributes to higher output of the machine. Furthermore, this entails savings in valuable material of the wire 1 and avoids unnecessary use of tools at the spring forming or coiling station.

If desired, the counters 51 and 51′ can be replaced with graduated scales or analogous indicia bearing members which are affixed to the frame 11, and pointer members which are attached to or otherwise movable with the cranks 52, 52′ relative to the corresponding scales. Alternatively, the scales can be rotated with or by the cranks 52, 52′ and the pointer members can be provided on the frame 11.

The purpose of the additional disc cams 38′ and 39′ is to enhance the versatility of the improved machine. Each of the additional cams 38′ renders it possible to make a spring having a different foremost portion than a spring which is produced while the cam 38 or another one of the cams 38′ is in use, and each of the additional cams 39′ allows for the making of a coil spring whose rearmost portion is different from that which is formed when the cam 39 or another one of the cams 39′ is in actual use. The cams 38, 38′ and 39, 39′ respectively form two groups of coaxial cams whose constituents are rigidly connected to each other. In other words, the cams 38 and 38′ (the number of such cams can be reduced below or increased above four) can be shifted as a unit axially of the hollow shaft 40, and the cams 39, 39′ (whose number will normally match the number of cams in the other group) can be shifted as a unit axially of the hollow shaft 41. A first shifting member 53 is provided to move the cams 38, 38′ axially of the hollow shaft 40, and a second shifting member 54 is provided to move the cams 39, 39′ axially of the hollow shaft 41. The shifting members 53, 54 are respectively secured to elongated toothed racks 55, 56 which respectively mesh with pinions 57, 58. The racks 55, 56 are parallel to the shafts 40–42, and the axes of the pinions 57, 58 are parallel to the aforementioned feed screws 32, 33, 45, 45′. The pinions 57, 58 are respectively secured to shafts 59, 60 which are rotatable in the frame 11 and whose outer end portions carry knurled knobs 63, 64 with pointers which are movable along suitably calibrated indicia bearing scales 61, 62. These scales can serve as bearings for the respective shafts 59, 60 and are installed in the frame 11 in such a way that the knobs 63, 64 are readily accessible to the person standing next to the cranks 52, 34, 35, 52′. Thus, an attendant standing in front of the machine frame 11 can shift a selected cam (38 or 38′) of the first group into register with the lever 24 by rotating the knob 63 clockwise or counterclockwise, and such person can also shift a selected cam (39 or 39′) of the second group into register with the lever 25 by rotating the knob 64 in a clockwise or counterclockwise direction.

As mentioned above, the cranks 34, 35, 52 and 52′ can be rotated to change the intervals of absence of pivoting of the levers 24, 25 and/or the extent of pivotal movement of the lever arms which are coupled to the links 18 and 19 while the machine is in actual use. It is advisable to shift the groups of cams 38, 38′ and 39, 39′ axially of the respective shafts 40, 41 while the machine is idle. This ensures that the levers 24, 25 cannot interfere with shifting of the corresponding groups of cams. Thus, once a proper pair of cams are moved into register with the levers 24 and 25, all other operations to turn out a certain type of screws can be carried out while the driver shaft 42 receives torque from the main prime mover. In other words, the attendants can change the initial or final stage of movement of the tool 3 as well as the extent of movement of the tool 3 while the machine is in the process of turning out springs. Of course, the adjustments via cranks 52, 34, 35, 52′ or other types of handles can be made before the machine turns out a certain type of springs so that the first of a long or short series of springs will be just as satisfactory as any other spring of the same series.

Figure 5:
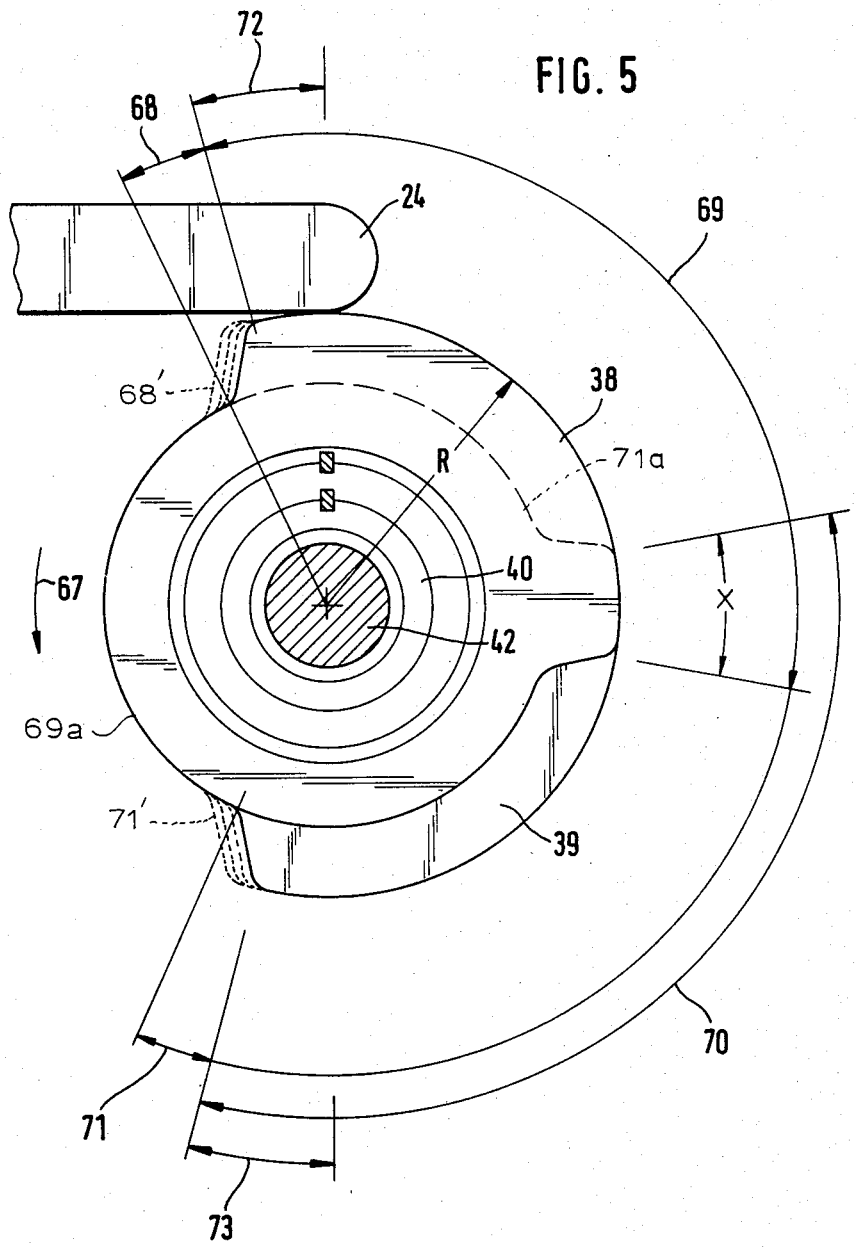
FIG. 5 is an enlarged sectional view as seen in the direction of arrows from the line V—V shown in FIG. 2.

FIG. 5 is an enlarged side elevational view of the cams 38 and 39 as seen in the direction of arrows from the line V—V in FIG. 2. The direction of rotation of the driver shaft 42 is indicated by the arrow 67. The cam 38 comprises a first or foremost portion or section 68 whose radius increases rather abruptly from a minimum value to a maximum value R. The next or second portion or section 69 has a constant radius R, and the third or final portion or section 68*a* has a minimal radius so that it cannot be reached by the respective arm of the lever 24.

The cam 39 (located behind the cam 38, as viewed in FIG. 5) has a first portion or section 70 with a constant (maximum) radius R, a second portion or section 71 whose radius decreases abruptly from R to a minimum value, and a third portion or section 71*a* whose radius is so small that it cannot be contacted by the respective arm of the lever 25. The radii of the sections 69*a* and 71*a* can be identical, and the radii R of the sections 69 and 70 are identical. The lever 24 tracks the first section 68 while the machine makes the initial convolution or convolutions of a spring, and the lever 25 tracks the section 71 while the machine makes the last convolution or convolutions of the same spring.

The combined length of the sections 69, 70 minus the length of the region X of overlap between these sections determines the interval of time during which the position of the tool 3 remains unchanged, i.e., while the machine makes the majority of convolutions of a spring. The length of the region X can be varied by adjusting the disc cams 38 and 39 relative to each other in the aforedescribed manner, i.e., by changing the angular position of the hollow shaft 40 and/or 41 with reference to the drive shaft 42 in response to rotation of the feed screws 45 and 45'.

The provision of additional disc cams 38' and 39' enhances the versatility of the improved machine because it is possible, by the simple expedient of axially shifting the cams 38, 38' and 39, 39', to move selected cams into register with the levers 24 and 25. Each of the cams 38, 38' can have a section 69 of different length, and each of the cams 39, 39' can have a section 70 of different length. Such more pronounced versatility of the improved machine is achieved by the simple expedient of axially movably mounting a relatively large number of disc cams on each of the hollow shafts 40 and 41. The first sections 68 of all cams 38, 38' can but need not be the same, and the configuration of the sections 71 of the cam 39 can be identical with the configuration of the corresponding section of each cam 39'. The number of additional cams 38', 39' can be increased well beyond three; this merely adds somewhat to the width of the improved machine, as considered in the axial direction of the driver shaft 42. FIG. 5 shows by broken lines the sections 68' of the cams 38' and the sections 71' of the cams 39'. It will be noted that the configuration of each of the three sections 68' is different, and the same holds true for the sections 71' of the cams 39'. Such selection of the configuration of sections 68' and 71' (i.e., that they are different from each other as well as from the sections 68, 71, respectively) contributes to versatility of the improved machine.

Figure 6:
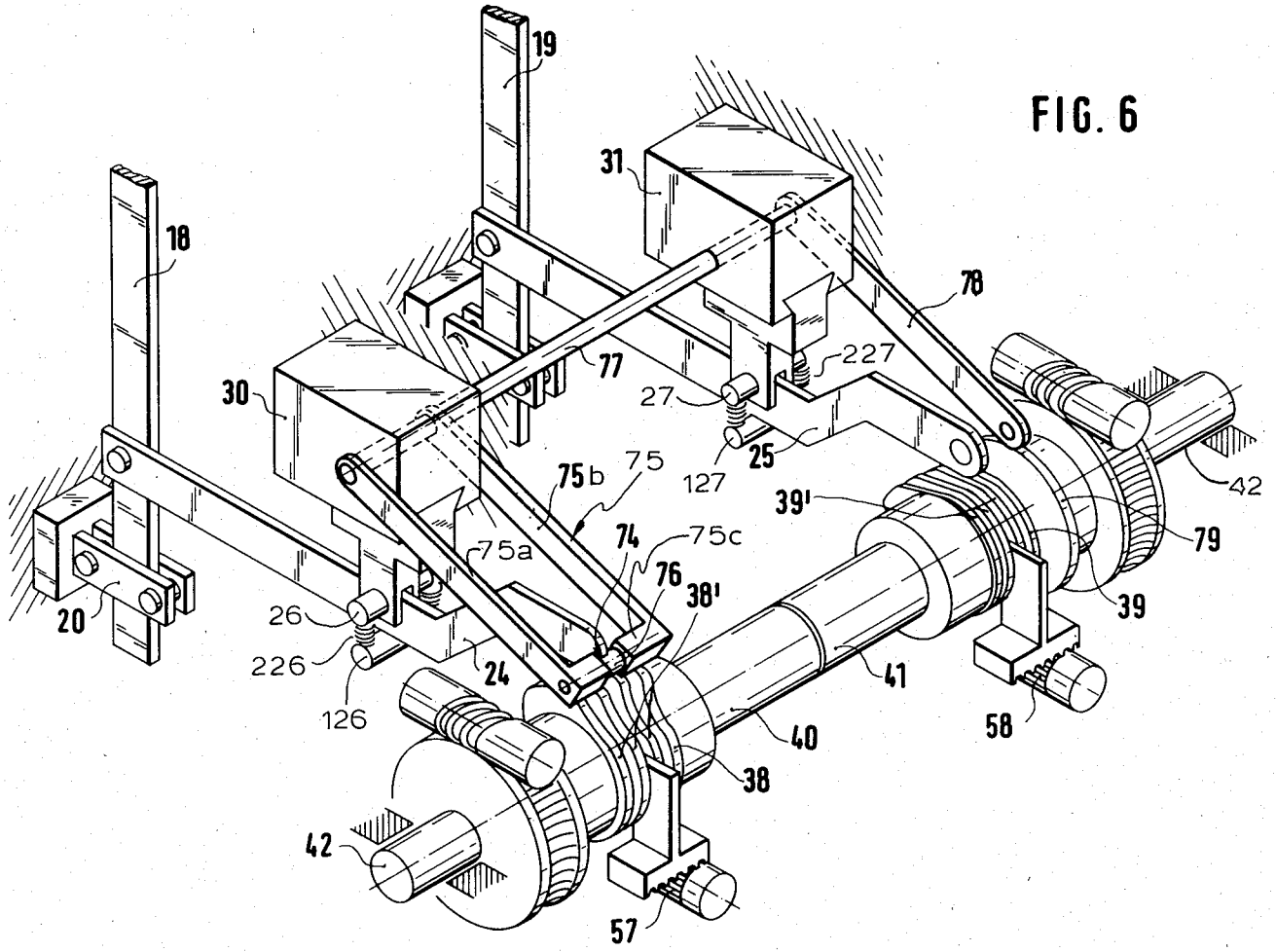
FIG. 6 is a fragmentary perspective view of a modified spring coiling machine.

FIG. 6 illustrates a portion of a modified machine wherein all such parts which are identical with or clearly analogous to the corresponding parts of the machine of FIGS. 1 to 5 are denoted by similar reference characters. An advantage of this machine is that it can employ cams 38, 38', 39, 39' wherein the length of sections 69 and 70, as considered in the circumferential direction of such cams, is the same. For example, the length of the sections 69 and 70 of the cams 38, 38' and 39, 39' can be limited to the angles 72 and 73 which are shown in FIG. 5. The lever 24 of this embodiment is formed with a detent notch 74 provided in the tip of that arm which is to track the cams 38, 38'. The machine further comprises a substantially U-shaped retaining pawl 75 with two parallel flanges 75*a*, 75*b* and a web 75*c* a portion of which includes a roller 76 adapted to enter the detent notch 74 of the lever 24. The flanges 75*a*, 75*b* are non-rotatably affixed to a rocking shaft 77 which is journalled in the bearings 30, 31 and is further rigidly connected with a follower lever 78 tracking a disc cam 79 driven by the shaft 41. The parts 77 to 79 constitute a control means for the pawl 75, and the parts 75–79 together constitute a device which disengages the follower 24 from the registering cam 38 or 38' during a certain stage of each cycle.

The operation is as follows:

If the lever 24 is adjacent to the smallest-diameter section 69*a* of the cam 38 of or one of the cams 38', and if the lever 25 is adjacent to the smallest-diameter section 71*a* of the cam 39 or of one of the cams 39', i.e., when the tool 3 is held in the idle or starting position, the roller 76 of the pawl 75 rests on the adjacent end portion of the lever 24. If the lever 24 is thereupon pivoted as a result of engagement with the section 68 of the cam 38 or with the section 68' of one of the cams 38', the roller 76 rolls along the adjacent edge face of the lever 24 toward the detent notch 74. The roller 76 enters the notch 74 as soon as the lever 24 begins to track the section 69 of the cam 38 or of one of the cams 38'. The pawl 75 then holds the lever 24 in the corresponding angular position with reference to the pivot member 26 until the free end portion of the follower lever 78 is engaged and the lever 78 is pivoted by a lobe on the cam 79. This pivots the lever 78 counterclockwise, as viewed in FIG. 6, and the shaft 77 causes the pawl 75 to extract its roller 76 from the detent notch 74 of the lever 24. The lever 25 is then free to engage the adjacent part (note the angle 73 in FIG. 5) of the cam 39 can resume the tracking of the peripheral surface of the cam 39 until it completes the tracking of the section 71. Note that the shaft 15 couples the levers 24, 25 to each other via links 18, 19.

The configuration of the cam 79 is such that its lobe or an analogous radially outwardly extending protuberance is located in the region where the lever 25 can engage the part 73 of the section 70 of the cam 39. This enables the cam 79 to disengage the pawl 75 from the lever 24 in the aforedescribed manner, i.e., during the aforedescribed stage of revolution of the hollow shaft 40 which carries the cams 38 and 38'.

The arrangement of FIG. 6 ensures that the sections 68 and 71 can be moved relative to each other at will and that, in each position of adjustment, the angular positions of the levers 24 and 25 remain identical.

The disengaging device including the parts 75 to 79 renders it possible to employ greatly simplified cams 38, 38' and 39, 39'. With reference to FIG. 5, the section 69 of each of the cams 38, 38' can be reduced in length (as considered in the circumferential direction of the shaft 40) so that it extends only along the arc 72. Analogously, the length of the section 70 of each of the cams 39, 39' can be reduced to that indicated by the arc 73. In other words, the major part of each section 69 and the major part of each section 70 can be omitted because the follower levers 24, 25 are held in predetermined angular positions by the pawl 75 during each revolution of the driver shaft 42. The extent of that angular movement of the cams 38, 38', 39 and 39' during which the follower levers 24, 25 cannot be influenced by the respective cams depends on the configuration of the control cam 79, i.e., the angular position of the cam 79, during each revolution of the driver shaft 42, will determine the timing of disengagement of the pawl 75 from the follower lever 24, and such timing will be selected with a view to ensure that the lever 25 then engages the (preferably shortened) section 70 of the cam 39 or of one of the cams 39' within the arc 73 shown in FIG. 5.

An advantage of the structure which is shown in FIG. 6 is that the length of the sections 69, 70 of the cams 38, 38' and 39, 39' is immaterial, as long as such length at least matches that indicated by the arc 72 for the sections 69 and by the arc 73 for the sections 70. This simplifies the design and making of such cams, i.e., all that is necessary is to provide each of the cams 38, 38' with a differently configurated section 68 or 68' and to provide each of the cams 39, 39' with a differently configurated section 71 or 71'.

The improved machine can be utilized for the automatic production of short or long series of a wide variety of coiled springs such as left- or right-hand coiled tension, compression and special springs with cylindrical, conical or bi-conical spring bodies, short or long or very long springs with closed end coils or conical ends, torsion springs with straight tangential legs and/or others. The machine may be of the single-finger or two-finger type (the single-finger system is preferred in connection with the production of tension springs with a high preload). The output of the machine is or can be in the range of several tens of thousands per hour.

As regards the various cutting and other tools at the coiling station, the improved machine may be constructed in the same way as or in a manner similar to that of the machine known as FA-6S which is manufactured and sold by the assignee of the present application. If the machine of the present invention is not of the numerically controlled type, the tool 3 can constitute or include a knife which severs the freshly formed coiled spring 101 from the wire 1.

The construction of the electrical controls of the machine forms no part of the invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A machine for converting wire into a series of coil springs during successive operating cycles of the machine, comprising a support; feeding means mounted in said support and operative to advance the wire along a predetermined path; a wire treating tool mounted on said support for movement with reference to said path; means for moving said tool, including first and second rotary cams and means for transmitting motion from said cams to said tool, said motion transmitting means including first and second follower means arranged to track the respective cams during first and second stages of each cycle so that the first cam determines the position of said tool during the making of a first portion and the second cam determines the position of said tool during the making of the remainder of each spring; and adjusting means for changing the position of at least one of said cams with reference to the other of said cams, irrespective of whether the machine is in operation or at a standstill, to thereby change the timing of transmission of motion from the one cam to said tool during successive cycle.

2. The machine of claim 1, wherein said first cam is coaxial with said second cam and said adjusting means includes means for turning at least one of said cams with reference to the other of said cams about the common axis of the cams.

3. The machine of claim 2, wherein said cams respectively include first and second sections which are tracked by the corresponding follower means, said first follower means being arranged to track said first section during the initial stage and said second follower means being arranged to track said second section during the last stage of the making of a spring.

4. The machine of claim 1, further comprising means for rotating said cams, including coaxial first and second shafts arranged to drive the respective cams and means for driving said shafts, said adjusting means including means for changing the angular position of at least one of said shafts with reference to the other of said shafts.

5. The machine of claim 1, wherein said adjusting means includes discrete first and second adjusting devices for the respective cams.

6. The machine of claim 5, wherein each of said adjusting devices includes a handle disposed at the exterior of said support.

7. The machine of claim 6, wherein each of said handles includes a rotary element mounted on said support.

8. The machine of claim 5, further comprising first and second means for indicating the positions of the respective cams with reference to one another.

9. The machine of claim 8, wherein each of said adjusting devices comprises a movable handle and each of said indicating means comprises an indicia bearing member and a pointer member adjacent to the indicia bearing member, one of said members being mounted on said support and the other of said members being movable with the respective handle.

10. The machine of claim 1, further comprising means for rotating said cams including coaxial first and second shafts connected to the respective cams, a driver element, and first and second adjustable transmissions interposed between said driver element and the respective shafts, said adjusting means including means for changing the angular position of at least one of said shafts with reference to the other of said shafts through the medium of the respective transmission.

11. The machine of claim 10, wherein said adjusting means includes discrete handles, one for each of said transmissions.

12. The machine of claim 10, wherein at least that one of said transmissions which is interposed between said one shaft and the driver element is a planetary transmission.

13. The machine of claim 12, wherein said planetary transmission comprises a first sun gear receiving torque from said driver element, a second sun gear transmitting torque to said one shaft, a planet carrier rotatable by said adjusting means, and planet pinion means rotatably mounted in said carrier and meshing with said sun gears.

14. The machine of claim 1, wherein each of said follower means comprises a lever having a first arm tracking the respective cam and a second arm, said moving means further comprising means for operatively connecting the second arms of said levers to said tool and further comprising means for varying the ratio of effective lengths of the first and second arms of at least one of said levers.

15. The machine of claim 14, wherein said ratio varying means comprises a pivot for said one lever and means for moving said pivot with reference to said one lever.

16. The machine of claim 15, wherein the means for moving said pivot comprises a rotary handle which is mounted on said support.

17. The machine of claim 16, further comprising means for indicating the position of said pivot including an indicia bearing member and a pointer member adjacent to said indicia bearing member, one of said members being mounted on said support and the other of said members being movable with said handle.

18. The machine of claim 1, further comprising at least one additional first and at least one additional second cam, said first and second cams and the respective additional cams respectively constituting first and second groups of cams and selected cams of each of said groups being shiftable into and from motion transmitting engagement with the respective follower means.

19. The machine of claim 18, wherein all of said cams are arranged to rotate about a common axis.

20. The machine of claim 19, wherein all of said cams are shiftable in the direction of said common axis.

21. The machine of claim 18, further comprising means for shifting a selected cam of each of said groups into and from motion transmitting engagement with the respective follower means.

22. A machine for converting wire into a series of coil springs during successive operating cycle of the machine, comprising a support; feeding means mounted in said support and operative to advance the wire along a predetermined path; a wire treating tool mounted on said support for movement with reference to said path; means for moving said tool, including first and second rotary cams and means for transmitting motion from said cams to said tool, said motion transmitting means including first and second follower means arranged to track the respective cams during first and second stages of each cycle so that the first cam determines the position of said tool during the making of a first portion and the second cam determines the position of said tool during the making of the remainder of each spring, said first cam including a first section which is tracked by the first follower means during the initial stage and said second cam including a section which is tracked by the second follower means during the last stage of the making of each spring, one of said cams further comprising a second section which is tracked by the respective follower means during the intermediate stage of the making of each spring; means for disengaging the follower means for the other of said cams from such other cam during said intermediate stage of the making of each spring; and adjusting means for changing the position of at least one of said cams with reference to the other of said cams to thereby change the timing of transmission of motion from the one cam to said tool during successive cycles.

23. The machine of claim 22, wherein said disengaging means comprises a retaining device for the follower means cooperating with said other cam and control means for engaging said retaining device with and for disconnecting said retaining device from the respective follower means as a function of the angular position of said one cam.

24. The machine of claim 23, further comprising means for rotating said cams including coaxial first and second shafts for the respective cams, said adjusting means comprising means for changing the angular position of at least one of said shafts with reference to the other of said shafts and said control means comprising a further cam driven by the shaft for said one cam and means for transmitting motion from said further cam to said retaining device.

* * * * *